United States Patent [19]

McDermott

[11] 4,008,018

[45] Feb. 15, 1977

[54] ROTARY FLUID DISPLACEMENT DEVICE HAVING IMPROVED PORTING

[76] Inventor: Hugh L. McDermott, 6101 Ashcroft Ave., Edina, Minn. 55424

[22] Filed: Nov. 28, 1975

[21] Appl. No.: 635,787

[52] U.S. Cl. ..... 418/171

[51] Int. Cl.[2] ..... F04C 1/06; F04C 15/00

[58] Field of Search ..... 418/61 R, 61 B, 166, 418/170, 171

[56] References Cited

UNITED STATES PATENTS

| | | | |
|---|---|---|---|
| 2,871,831 | 2/1959 | Patin | 418/61 B |
| 2,872,872 | 2/1959 | Quintilian | 418/171 X |
| 3,129,875 | 4/1964 | Cirillo | 418/171 |
| 3,224,421 | 12/1965 | Peras | 418/61 B X |

*Primary Examiner*—C. J. Husar
*Assistant Examiner*—Leonard Smith
*Attorney, Agent, or Firm*—Merchant, Gould, Smith, Edell, Welter & Schmidt

[57] ABSTRACT

Fluid inlet and outlet porting for a rotary fluid displacement device including a housing defining a cylindrical chamber and a pair of cooperating respective internally and externally toothed ring and star members in the chamber, the ring member encompassing the star member and having teeth at least one more in number than the star member, the members rotating on spaced parallel axes with the teeth thereof moving into and out of intermeshing engagement to provide alternately expanding and contracting fluid compartments. Inlet and outlet ports opening respectively to the expanding and contracting chambers, extend generally circumferentially of the ring member, the inlet port having one end in the shape of portions of the teeth of the ring and star members, said one end of the inlet port being disposed adjacent an area wherein the teeth of the members are out of intermeshing engagement.

4 Claims, 5 Drawing Figures

ROTARY FLUID DISPLACEMENT DEVICE HAVING IMPROVED PORTING

BACKGROUND OF THE INVENTION

This invention relates generally to gear pumps or motors, and more particularly to improvements in such devices of the type using "Gerotor" mechanisms wherein externally and internally toothed members cooperate to define successively expanding and contracting fluid compartments during rotation of the members on spaced parallel axes, the teeth of the members moving into and out of intermeshing engagement. Fluid flows into the expanding compartments and out of the contracting compartments through inlet and outlet ports respectively in at least one of the end walls of the cylindrical chamber defined by a casing and in which the toothed members are rotatably mounted. Heretofore, the inlet and outlet ports have been more or less kidney shaped, having square or rounded ends and, in many instances, the expanding compartments move beyond the end of the inlet port before becoming completely filled with fluid, thus contributing to inefficient operation. When such a device is used with incompressible liquids, such as water or oil, noisy operation and undue wear occurs.

SUMMARY OF THE INVENTION

A rotary fluid displacement device involving the fluid porting arrangement of this invention includes a housing defining a cylindrical chamber having a cylindrical wall and axially opposite end wall means, a drive shaft journaled in the housing on an axis in spaced parallel relation to the axis of the cylindrical wall, an externally toothed star member fixed on the drive shaft, an internally toothed ring member encompassing the star member and journaled in the chamber concentric therewith, said ring member having internal teeth greater in number than the teeth of said star member and moving into and out of engagement therewith during rotation of said members on their respective axes to provide successively expanding and contracting compartments respectively. The star and ring member each have axially opposite ends in rotary sliding engagement with said chamber end wall means. Inlet and outlet ports defined by the housing in the end wall means are in register with said expanding and contracting chambers respectively, and passage means lead from said ports to the exterior of the housing. One of said ports has one end in the shape of portion of the teeth of said members.

DESCRIPTION OF THE PREFERRED EMBODIMENT

Figure 1:
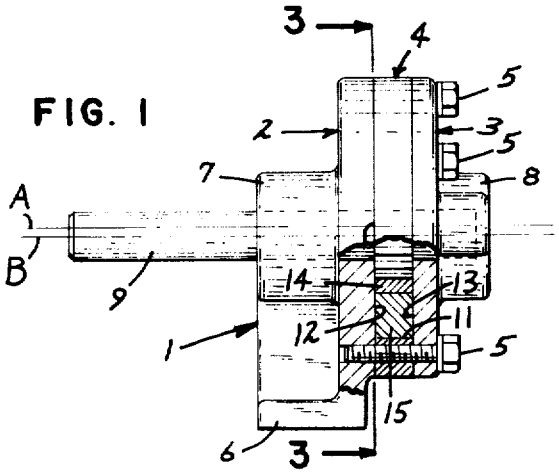
FIG. 1 is a view in side elevation of a fluid displacement device produced in accordance with this invention, some parts being broken away and some parts being shown in section.
Figure 2:
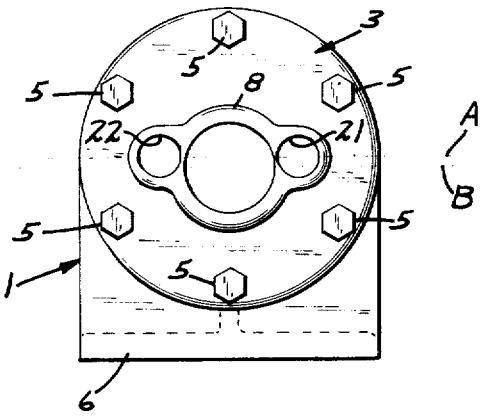
FIG. 2 is a view in end elevation, as seen from the right to the left with respect to FIG. 1.

The rotary fluid displacement device herein described may be used selectively as a fluid pump or fluid motor and, in the embodiment illustrated, involves a housing 1 comprising opposite end housing sections 2 and 3 and an annular intermediate housing section 4, these being releasably held together by a plurality of circumferentially spaced machine screws 5. The end section 2 is formed to provide a mounting base portion 6, both end sections 2 and 3 being formed to provide bearing bosses 7 and 8 respectively for journaling a drive shaft 9 that projects axially outwardly from the bearing boss 7.

The housing sections 2–4 cooperate to define a cylindrical chamber 10 having a cylindrical wall 11 and axially opposite end walls 12 and 13. It will be noted that the axis of the cylindrical wall 11 is disposed in spaced parallel relationship to the axis of the drive shaft 9, the axis of the cylindrical wall 11 being indicated at A, and the axis of the drive shaft 9 being indicated at B.

An externally toothed star member 14 is splined or otherwise fixed on the drive shaft 9 for rotation therewith, and an internally toothed ring member 15 encompasses the star member 14, the ring member 15 having a cylindrical outer surface which has a running fit with the cylindrical wall 11 and rotates on the axis A of the cylindrical wall 11. For the purpose of the present example, the star member 14 is shown as having fixed rounded teeth 16, the ring member 15 being shown as having internal teeth 17 that are greater in number than the teeth 16. In the embodiment illustrated, the internal teeth 17 are seven in number. The teeth 16 and 17 are so shaped that, during rotation of the ring member 15 and star member 14 on their respective axes A and B, the teeth 16 and 17 move successively into and out of intermeshing engagement to define alternately expanding and contracting fluid compartments 18.

Figure 3:
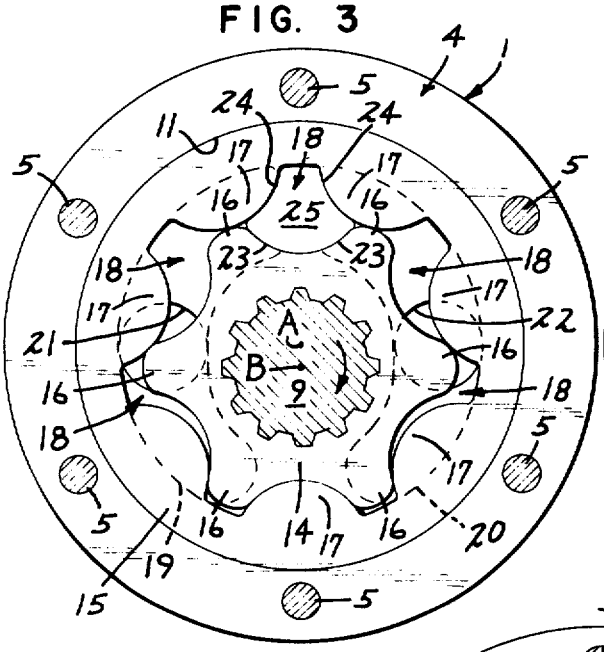
FIG. 3 is an enlarged transverse section taken on the line 3—3 of FIG. 1.
Figure 4:
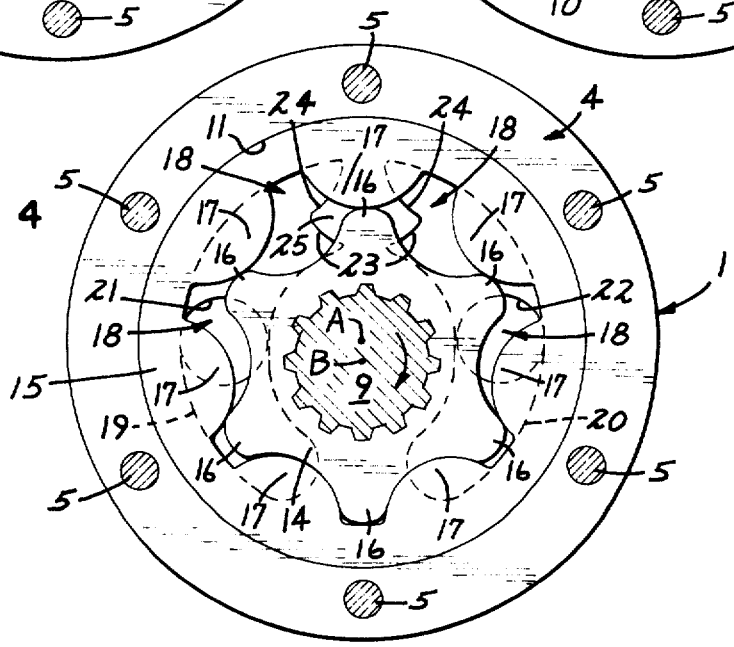
FIG. 4 is a view corresponding to FIG. 3 but showing a different position of some of the parts.

The end wall 13 of the chamber 10 is shown as being formed to provide a pair of ports 19 and 20 each of which communicates with a respective one of a pair of fluid passages 21 and 22 that extend to the exterior of the housing 1. As shown, the ports 19 and 20 extend generally circumferentially of the chamber 10, each port 19 and 20 having opposite ends disposed in circumferentially spaced relationship to corresponding ends of the other port. At one of their ends, the ports 19 and 20 are spaced apart in the area wherein the teeth 16 and 17 are fully out of intermeshing engagement, the other ends of the ports 19 and 20 being spaced apart in an area where the teeth 16 and 17 are in full intermeshing engagement, as shown in FIGS. 3 and 4. In the embodiment of the invention illustrated, the upper ends of the ports 19 and 20 are disposed in the area where the teeth 16 and 17 are fully out of intermeshing engagement. The upper ends of the ports 19 and 20 each define a pair of curved portions 23 and 24. The curved portions 23 correspond to the outlines of a portion of each external tooth 16, the curved portions 24 corresponding in shape or outline to portions of the internal teeth 17. The curved portions 23 and 24 are so oriented and spaced apart that they define the sides of an area indicated at 25, which corresponds substantially in shape and size to that of a fluid compartment 18 in its fully expanded condition.

Figure 5:
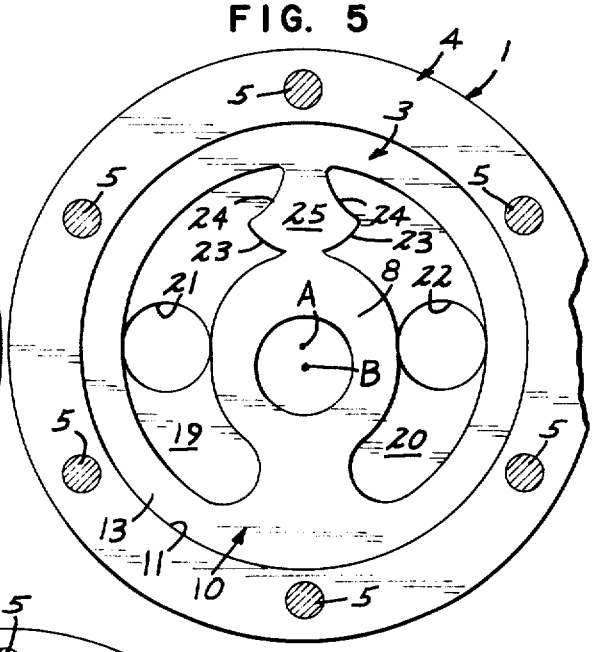
FIG. 5 is a view corresponding to FIGS. 3 and 4, some parts being removed.

During rotation of the shaft 9 with its star member 14, and ring member 15, on their respective axes B and A, fluid flows into whichever port 19 or 20 communicates with the expanding chambers 18, depending upon the direction of rotation of the members 14 and 15. Assuming that the present device is being used as a pump and that the shaft 9, star member 14 and ring member 15 are being rotated by suitable means, not shown, in a clockwise direction with respect to FIGS. 3 and 5, the passage 21 and port 19 become an inlet passage and inlet port respectively, the port 20 and passage 22 being a respective outlet or delivery port and passage. As the members 14 and 15 rotate, each compartment 18 moves from its fully contracted position at the bottom portion of the cylindrical chamber 10 into registration with the lower end portion of the inlet port 19 to receive fluid therefrom. When each compartment 18 reaches its maximum expanded condition at the top portion of the cylindrical chamber 10, the wall portions 23 and 24 at the upper end of the port 19 are coincident with like portions of teeth 16 and 17 respectively, so that each expanding compartment 18 becomes entirely filled with the fluid being pumped. Then, as the members 14 and 15 continue their rotation, the fully expanded compartment 18 moves into register with the upper end portion of the outlet port 20 to begin discharge of the fluid thereinto and into the outlet passage 22. By having the adjacent upper ends of the ports 19 and 20 shaped in the manner above described, to provide an area therebetween in the shape of a fully expanded fluid compartment 18, complete filling of each compartment 18 and consequent smooth and efficient operation is insured. Similar smooth and efficient operation is obtained when the device is used as a rotary fluid motor, as well.

By having the upper end portions of both ports 19 and 20 shaped to provide the arcuate end portions 23 and 24, the device of this invention will operate equally well whether the members 14 and 15 rotate in clockwise or counterclockwise directions. In the event that the device is intended for rotation of the members 14 and 15 in but a single direction, only the upper end of the inlet port need have the curved portions 23 and 24 to obtain the desired results.

While I have shown and described a commercial embodiment of my fluid displacement device, it will be understood that the same is capable of modification without departure from the spirit and scope of the invention, as defined in the claims.

I claim:

1. In a rotary fluid displacement device comprising, a housing defining a cylindrical chamber having a cylindrical wall and axially opposite end wall means, a drive shaft journaled in the housing on an axis in spaced parallel relation to the axis of the cylindrical wall, an externally toothed star member fixed on the drive shaft, an internally toothed ring member encompassing the star member and journaled in the chamber concentric therewith, said ring member having internal teeth greater in number than the teeth of said star member and moving into and out of engagement therewith during rotation of said members on their respective axes to provide successively expanding and contracting compartments respectively, said star member and ring member each having axially opposite ends in rotary sliding engagement with said chamber end wall means; characterized by inlet and outlet ports defined by said housing in said end wall means in register with said expanding and contracting chambers respectively, and passage means leading from said ports to the exterior of the housing, said inlet port having one end defining a pair of curved portions angularly displaced from each other, the curvature of each of said portions corresponding to the curvature of a tooth portion of a different respective one of said members and coincident respectively with corresponding tooth portions of both of said members in given relative positions of rotation between said members.

2. The rotary fluid displacement device defined in claim 1 in which said ports are disposed in one of said end wall means, said one of the end wall means having an area between said port ends which in part corresponds in outline generally to that of a fully expanded fluid compartment.

3. The rotary fluid displacement device defined in claim 1 in which one end of said inlet port is disposed at an area wherein the teeth of said members are fully out of intermeshing engagement.

4. The rotary fluid displacement device defined in claim 3 in which each of said ports extends in a direction circumferentially of said chamber, said outlet port having one end in circumferentially spaced opposed relationship to said one end of said inlet port and having a pair of curved portions angularly displaced from each other, the curvature of each of said portions of said outlet port corresponding to the curvature of a tooth portion of a different respective one of said members and being curved in generally opposite directions from respective curved portions of said inlet port.

* * * * *